US009533399B2

(12) United States Patent
Noniewicz et al.

(10) Patent No.: US 9,533,399 B2
(45) Date of Patent: Jan. 3, 2017

(54) CLAMP CONNECTOR

(71) Applicant: WOLFCRAFT GMBH, Kempenich (DE)

(72) Inventors: Zbigniew Noniewicz, Kempenich (DE); Hans-Jürgen Schüller, Königsfeld (DE)

(73) Assignee: WOLFCRAFT GMBH, Kempenich (DE)

( * ) Notice: Subject to any disclaimer, the term of this patent is extended or adjusted under 35 U.S.C. 154(b) by 0 days.

(21) Appl. No.: 14/764,741

(22) PCT Filed: Feb. 4, 2014

(86) PCT No.: PCT/EP2014/052075

§ 371 (c)(1),
(2) Date: Jul. 30, 2015

(87) PCT Pub. No.: WO2014/118379

PCT Pub. Date: Aug. 7, 2014

(65) Prior Publication Data

US 2015/0360348 A1 Dec. 17, 2015

(30) Foreign Application Priority Data

Feb. 4, 2013 (DE) ..... 20 2013 100 494 U

(51) Int. Cl.
*B25B 5/00* (2006.01)
*B25B 5/06* (2006.01)
*B25B 5/10* (2006.01)

(52) U.S. Cl.
CPC ..... *B25B 5/003* (2013.01); *B25B 5/068* (2013.01); *B25B 5/102* (2013.01); *Y10T 403/60* (2015.01)

(58) Field of Classification Search
CPC ..... Y10T 403/32467; Y10T 403/32508; Y10T 403/4637; Y10T 403/4662; Y10T 403/32426; Y10T 403/32442; Y10T 403/32459; Y10T 403/57; Y10T 403/5733; Y10T 403/5741; Y10T 403/5766; Y10T 403/5773; B25B 5/00; B25B 5/068; B25B 5/102; B25B 5/16; B25B 5/06; B25B 5/166; B25B 5/10; B25B 5/163; B25B 5/003
See application file for complete search history.

(56) References Cited

U.S. PATENT DOCUMENTS 4,042,264 A * 8/1977 Shumer ..... B25B 5/068 269/203
4,132,489 A * 1/1979 Berg, Jr. ..... F16B 7/0426 15/144.3

(Continued)

FOREIGN PATENT DOCUMENTS

DE 8409755 U1 7/1984
DE 8903875 U1 12/1989

(Continued)

*Primary Examiner* — Daniel Wiley
(74) *Attorney, Agent, or Firm* — Lucas & Mercanti, LLP; Klaus P. Stoffel

(57) ABSTRACT

A device for connecting two clamps, each of which has a rail, including a housing that has two insertion openings, which point away from each other and each of which has an adjoining insertion channel, for inserting a respective rail. The device also includes at least one adapter piece which can be inserted into one of the insertion openings and which reduces the free opening cross section of the insertion channel in order to insert a rail with a different cross-sectional area. The adapter piece has a lining which adjoins a collar. The lining rests against the wall of the insertion channel at least in some regions and forms an insertion channel with a reduced cross section in the inserted state, and the collar rests on an end face of the housing.

21 Claims, 6 Drawing Sheets

(56) References Cited

U.S. PATENT DOCUMENTS 4,314,771 A * 2/1982 Lambert ..... F16B 7/0426 16/429
4,960,009 A * 10/1990 Schultz ..... F16H 59/0208 403/224
5,174,553 A * 12/1992 Challis ..... B25B 5/068 269/203
5,915,712 A * 6/1999 Stephenson ..... A61G 5/10 16/422
6,123,326 A * 9/2000 Kleinbongartz ..... B25B 5/068 269/143
6,530,565 B1 * 3/2003 Simpson ..... B25B 5/166 269/147
6,578,837 B1 6/2003 Blank et al.
6,962,918 B2 11/2005 Orme et al.
7,322,571 B2 * 1/2008 Springer ..... B25B 5/003 269/43
7,322,572 B1 * 1/2008 Yang ..... B25B 5/068 269/3
7,396,004 B2 * 7/2008 Kern ..... B25B 5/003 269/3
7,398,966 B2 * 7/2008 Hubbard ..... B25B 5/068 269/155
8,424,856 B2 * 4/2013 Lombardi ..... B25B 5/068 269/249
8,827,251 B2 * 9/2014 Kuo ..... B25B 5/163 269/3
9,073,180 B2 * 7/2015 Yang ..... B25B 5/068
2007/0057424 A1 3/2007 Kern
2007/0090580 A1 * 4/2007 Fratianne ..... B25B 5/068 269/6
2007/0176342 A1 8/2007 Noniewicz
2008/0237959 A1 * 10/2008 Tseng ..... B25B 5/068 269/86
2011/0079946 A1 * 4/2011 Yang ..... B25B 5/003 269/88
2012/0098182 A1 * 4/2012 Yang ..... B25B 5/166 269/208
2013/0134642 A1 * 5/2013 Chen ..... B25B 5/006 269/6
2015/0246431 A1 * 9/2015 Shute ..... B25B 5/163 144/195.4

FOREIGN PATENT DOCUMENTS

DE 19529268 A1 4/1997
DE 19731579 A1 1/1999
DE 19861130 A1 4/2000
DE 10131966 A1 3/2002
DE 102004011636 A1 9/2005
DE 202009013416 U1 4/2010

* cited by examiner

CLAMP CONNECTOR

The present application is a 371 of International application PCT/EP2014/052075, filed Feb. 4, 2014, which claims priority of DE 20 2013 100 494.4, filed Feb. 4, 2013, the priority of these applications is hereby claimed and these applications are incorporated herein by reference.

BACKGROUND OF THE INVENTION

The invention relates to a device for connecting two clamps each having a rail, comprising a housing which has two insertion openings which point away from one another and which each have an adjoining insertion channel for inserting a respective rail.

A generic device is described by DE 195 29 268 A1. The document describes clamping tools constructed in different ways, which each form a rail to which a fixed clamping jaw is fastened. A movable clamping jaw bearing a thrust piece which is movable by suitable means in the direction of the fixed clamping jaw. The thrust piece can be moved by a screw spindle. However it is also possible for the movable clamping jaw to be displaced by means of a step clamping mechanism in the direction of the fixed clamping jaw. Clamping tools in this connection are described inter alia in DE 89 03 875, DE 84 09 755, U.S. Pat. No. 6,962,918 and DE 197 31 579 A1.

The two free ends of the rails two clamps can be connected to one another with the generic rail connector. The clamps which are on the market have rails which have different cross-sections from one another.

SUMMARY OF THE INVENTION

The object of the invention is to increase the range of applications for a rail connector.

The object is achieved by the invention in that an adapter piece can be inserted into one of the two insertion openings of a rail connector. If no adapter piece is located in the insertion opening, a rail with a large cross-section, in particular with a rectangular cross-section, can be inserted into the insertion opening and into the adjoining insertion channel. If an adapter piece is inserted into the insertion opening, a rail, with a different cross-section, in particular a rectangular cross-section with a smaller cross-sectional area, can be inserted into the rail connector. In this connection the adapter piece reduces the free opening cross-section of the insertion channel of the rail connector housing for insertion of a rail with a different cross-sectional area. The adapter piece may have a flange. In the inserted state the flange is located on an end face section of the rail connector housing with which the insertion opening is associated. A lining is preferably formed on the flange. The lining is located on portions of the inner surface of the insertion channel formed by the housing. The lining in turn forms an insertion channel which is associated with the adapter piece. The adapter piece may be produced in one piece out of plastic. The housing of the rail connector can likewise be manufactured from plastic. The lining may be of U-shaped configuration in cross-section. The two arms of the U extending parallel to one another can form narrow walls of which the outer faces rest at least in some regions on the narrow side surface of the insertion opening associated with the housing. The two narrow walls can be connected to a broad side 11 which forms the linking part of the U. The broad side wall can have a bulge which is in particular trough-shaped. Latching means are provided, by which the adapter piece can be held within the insertion channel of the housing. In this connection a latching lug can be provided which penetrates into a latching recess. The latching lug can be disposed on a latching tab of the broad side wall of the adapter piece and can engage in a latching recess which is formed by a window in the insertion channel of the housing. The two broad side surfaces of the insertion opening of the housing can in each case form convexities. These may form grooves. When the rail is inserted, stops can enter into these convexities. In the rail the purpose of these stops is to secure the movable clamping jaw to the rail. The broad side wall of the adapter piece can likewise have a convexity for this purpose. The outline of the insertion opening in the housing and the insertion opening in the adapter piece can form the shape of a cross. Thus the insertion opening in the adapter piece or the insertion opening in the housing forms a cross-shaped window. The rail connector according to the invention preferably has an arrangement in mirror symmetry. In particular locking devices, by which the rails of the clamps to be coupled to one another can be fastened to the rail connector, are disposed in mirror symmetry. In this connection locking bolts are provided which can enter into locking openings in the rail. Each of the two locking bolts can be brought independently of the other one from a locking position into a release position by actuation of a push button. In this case the push button is in a housing recess, which is located in a broad side surface of the housing. The push button can be displaced into the recess against the restoring force of a spring. It is coupled by means of a rod to a support on which the locking bolt is located. The locking bolt intersects the insertion channel and is brought out of the locking position into the release position by pressure on the push button.

An exemplary embodiment of the invention is illustrated in the appended drawings and is explained in greater detail below. In the drawings:

DETAILED DESCRIPTION OF THE INVENTION

Figure 1:
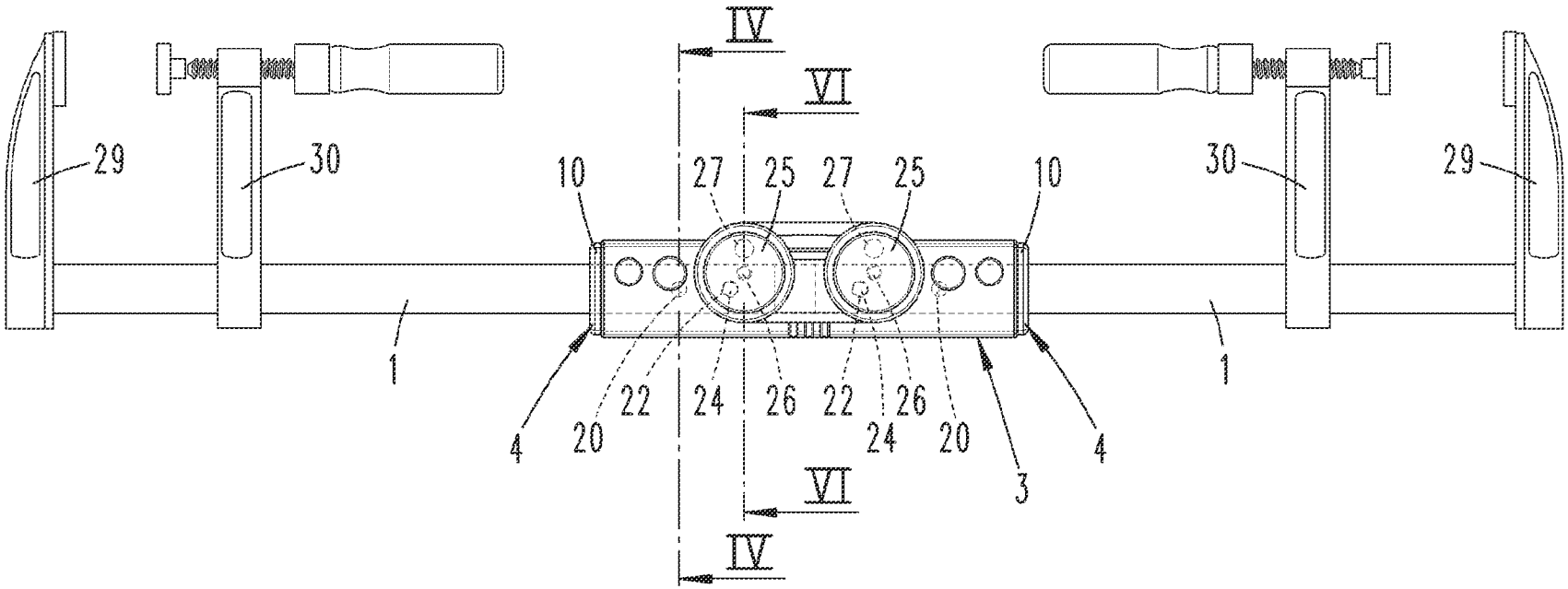
FIG. 1 shows a plan view of two clamps which are coupled to one another by means of a rail connector 3.
Figure 2:
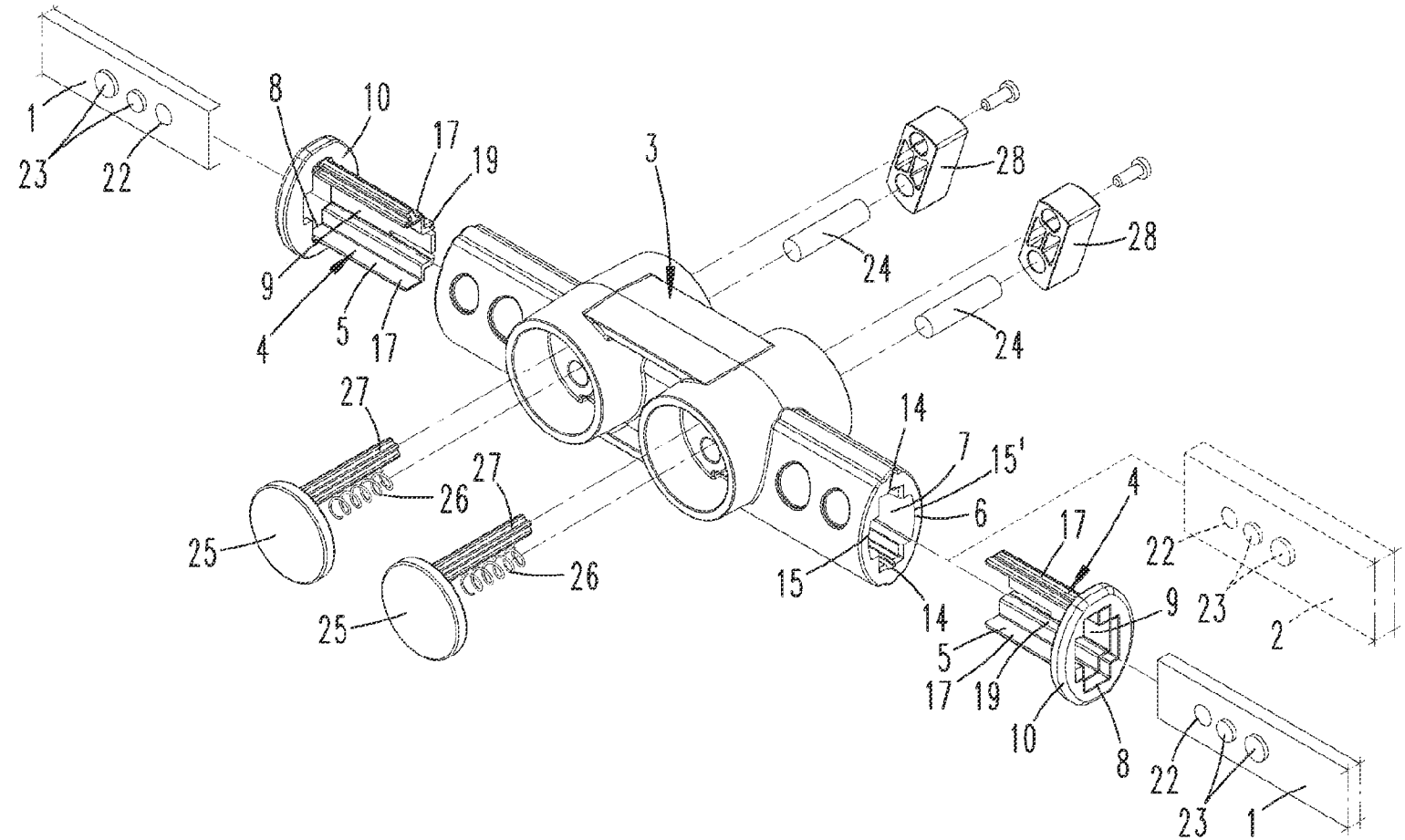
FIG. 2 shows a first exploded view of the rail connector 3.
Figure 3:
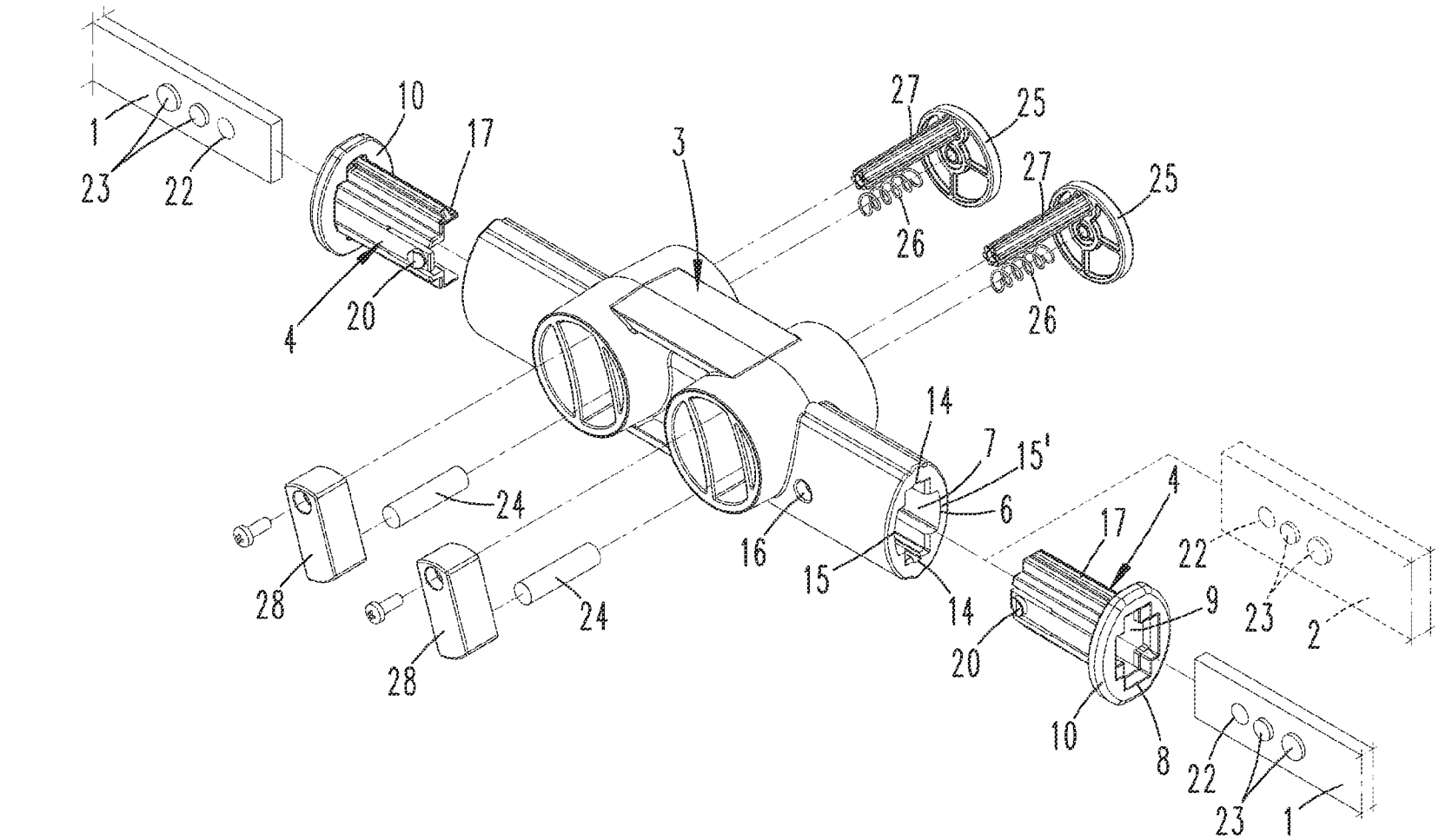
FIG. 3 shows a second exploded view of the rail connector 3.
Figure 4:
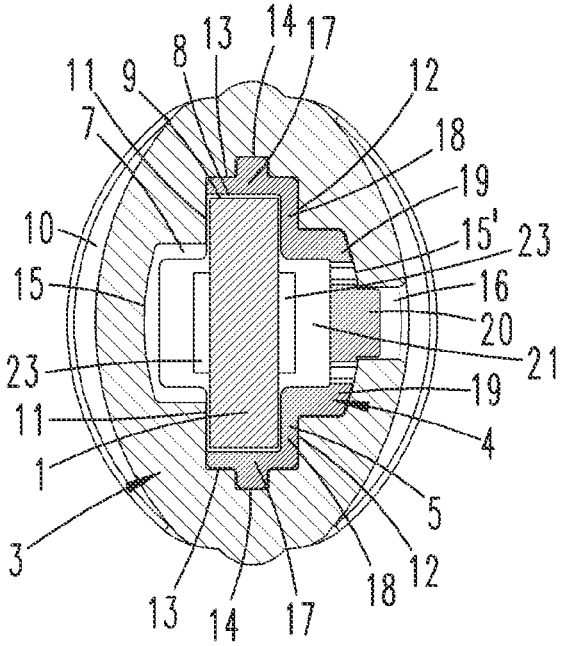
FIG. 4 shows a cross-section according to the sectional line IV-IV in FIG. 1, wherein an adapter piece 4 is inserted into the insertion channel 7 of the rail connector 3 and a rail 1 with a small rectangular cross-sectional area is inserted into the insertion channel 9 of the adapter piece 4.

The rail connector 3 has an elongate housing which on its narrow sides which face away from one another has in each case an insertion opening 6 for insertion of a substantially rectangular rail 1, 2 of a clamp. Each of the two rail ends inserted into the rail connector 3 has a locking opening 22 in which a locking bolt 24 engages, in order to secure the two rails 1, 2 to the rail connector 3.

The two ends of the rails 1, 2 opposite the free ends are in each case connected to fixed clamping jaws 29. A movable clamping jaw 30, having a thrust piece which can be displaced in the direction of the fixed clamping jaw 29, slides on the rail 1, 2. However, the clamping jaws 29 can also be separable from the rail 1, 2, as described for example in DE 10 2004 011 636 A1 and DE 101 31 966 A1. The movable clamping jaws 30 or the thrust pieces associated therewith can then be displaced in the direction away from one another, so that such an arrangement consisting of two rails connected to one another forms a spreader clamp.

According to the invention provision is also made for the movable clamping jaw 30 to have an advancing mechanism, such as is described in DE 198 61 130 A1, so that by actuation of a handle several times the movable clamping jaw 30 can be displaced along the rail 1, 2 in the clamping direction. However, this, or also a movable clamping jaw bearing a screw spindle, can also be disposed on the rails 1, 2 which are associated with it and are connected to one another by the rail connector 3 in such a way that the clamping jaw or the thrust pieces are directed towards one another. Then a workpiece can be gripped between the two movable clamping jaws 30. The possibility also exists that only one of the two rails 1, 2 connected to one another by the rail connector 3 bears a fixed clamping jaw 29. The other rail then bears a movable clamping jaw 30, the thrust piece of which is directed towards the fixed clamping jaw.

The rail connector 3 forms a housing made of plastic. The housing has two narrow sides directed away from one another. An insertion opening 6 which has a cross-shaped outline is located in each of the two narrow sides. The insertion opening 6 adjoins an insertion channel 7. The two insertion channels 7 can be connected to one another. Each of the two channels 7 has corner regions which define a substantially rectangular basic cross-section and forms opposing narrow side surfaces 13 and opposing broad side surfaces 11, 12. The broad side surface 11 additionally has an elongate convexity 15, into which a stop 23 fastened to the rail 1, 2 can enter. The stop 23 serves for securing the movable clamping jaw 30 to the rail 1, 2.

The broad side surface 12 opposite the broad side surface 11 likewise has an elongate convexity 15'. A stop 23 on the rail 1, 2 can also enter into this convexity.

Figure 5:
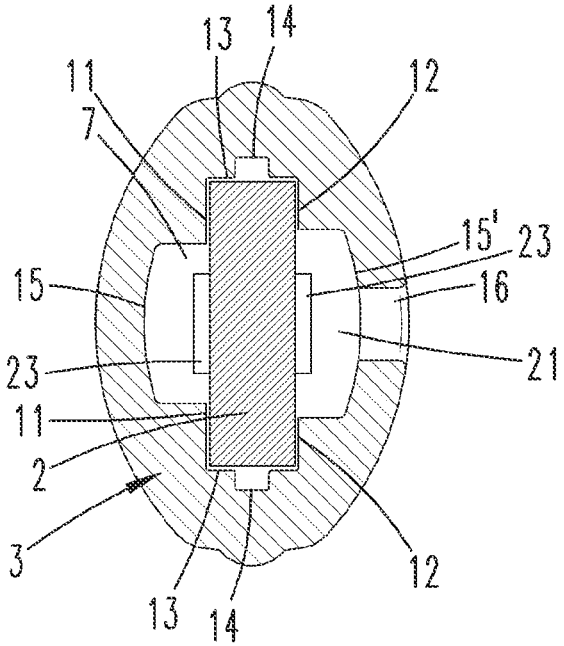
FIG. 5 shows a representation according to FIG. 4, but without the adapter 4 inserted into the insertion channel 7 of the rail connector 3, but with a rail 2 which has a greater rectangular cross-sectional area.
Figure 7:
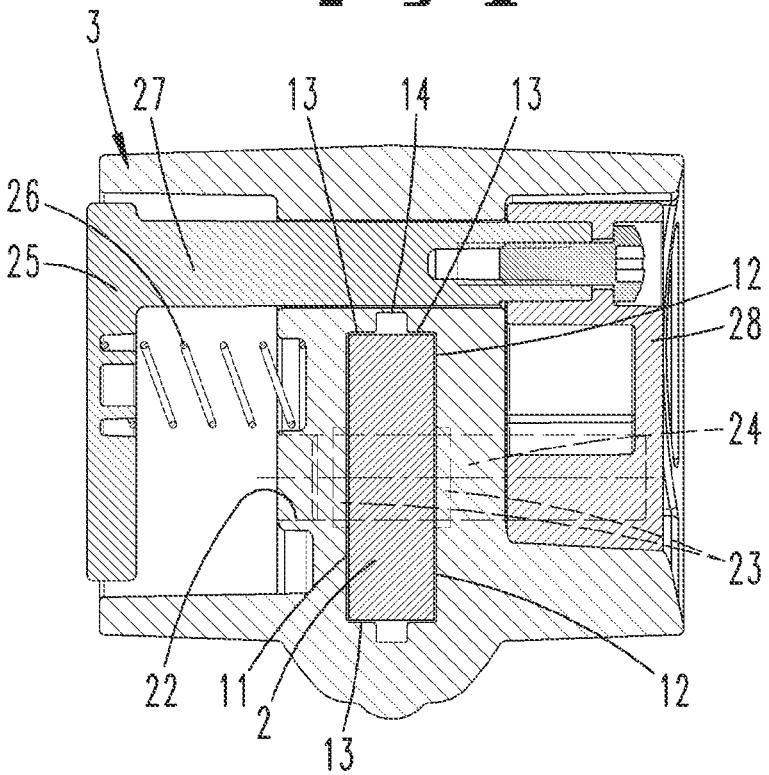
FIG. 7 shows a representation according to FIG. 6, but without the adapter piece 4 and with a rail 2 having a greater cross-sectional area inserted into the insertion channel 7 of the rail connector 3.
Figure 8:
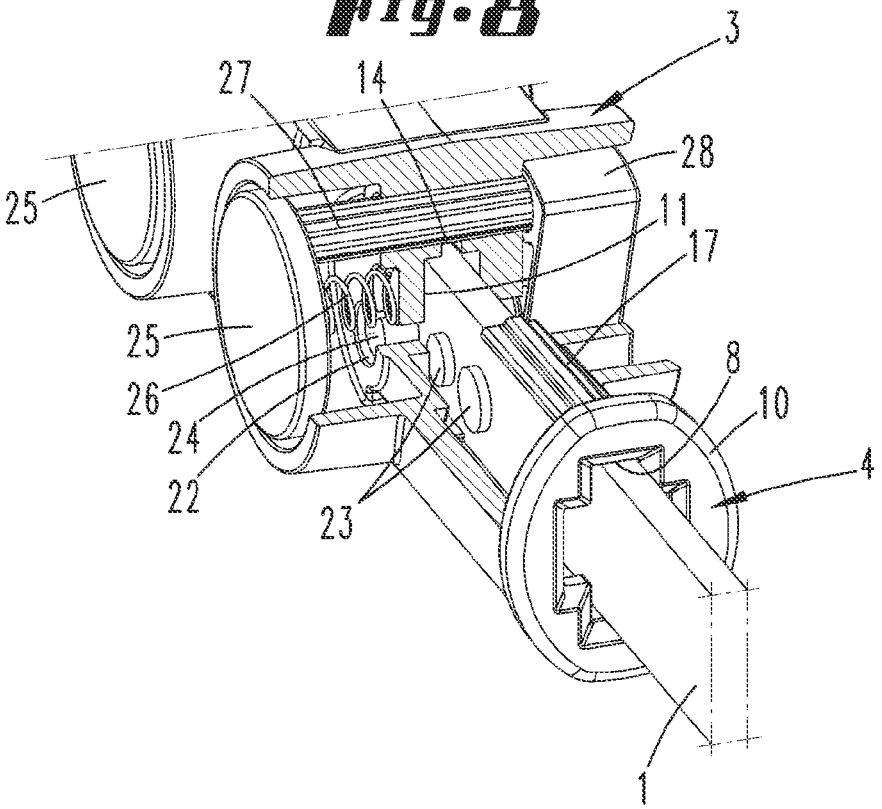
FIG. 8 shows a partially cut-away representation of an adapter piece 4 inserted into the insertion channel 7.

FIGS. 5 and 7 show the cross-section through the rail connector and through the insertion channel 7, wherein a rail having a large cross-sectional area and a rectangular cross-section is inserted into the insertion channel 7. The two opposing narrow side surfaces of the rail 2 rest with a slight clearance against the narrow side surfaces 13 of the insertion channel 7. In each case portions of the broad sides of the rail 2 rest against the broad side surfaces 11, 12.

A locking bolt 24, which is fastened to a support 28, engages in the locking opening 22 of the rail 2. The support 28 is connected to a rod connection 27 which intersects the rail connector 3 and has a push button 25. The push button is inserted in a housing recess and is acted on by a compression spring 26. Such a push button arrangement is known for example from DE 101 31 966 A1. Reference is made to the statements in this connection in the aforementioned document.

If rails 1, of which the cross-sectional area is smaller than the cross-sectional area of the rails 2, are to be connected to one another adapter pieces 4 are inserted into the two insertion channels 7 in the rail connector 3. However, it is also possible to connect rails with a different cross-sectional area to one another. Then adapter pieces 4 which are different from one another are inserted into the insertion openings 6 of the rail connector 3 or only one adapter piece 4 is inserted into an insertion opening in the rail connector 3.

The adapter piece 4 according to the invention has a flange 10, which in the inserted state rests on the end face of the rail connector 3 surrounding the insertion opening 6. The flange 10 forms a substantially cross-shaped insertion opening 8 adjoined by an insertion channel 9. The insertion channel 9 is formed by a lining 5 having a substantially U-shaped cross-section. However, the lining 5 may also have a closed cross-section, that is to say the shape of a tube.

In the exemplary embodiment the lining 5 has two opposing narrow walls 17, which rest with their outer faces against the narrow side surfaces 13 of the insertion channel 7. The narrow side surface 13 of the insertion channel 7 has in cross-section a niche 14 which is filled by a rib of the narrow wall 17. The free cross-section of the opening channel is reduced in a first direction by the narrow walls 17.

The two narrow walls 17 are connected to one another by a broad side wall 18. An outer wall portion of the broad side wall 18 rests against the broad side surface 12 of the insertion channel 7. The free opening cross-section of the insertion channel 7 is reduced by the broad side wall 18 in another, second direction perpendicular to the first direction.

In the exemplary embodiment the insertion channel 9 for insertion of the rail 1, which has a small cross-sectional area, is formed by the two narrow walls 17 and a broad side wall 18. The opposing broad side wall of the insertion channel 9 is formed by the broad side surface 11 of the housing 3.

The broad side wall 18 of the lining 5 forms a convexity 21. The outwardly directed wall of the convexity 21 rests against the inner wall of the convexity 15' on the broad side surface 12 of the insertion channel 7 of the housing 3.

A latching lug 20 is provided which is located at the end of a spring tab formed by the bulge 19 which forms the convexity 21. The outwardly directed latching lug 20 can enter a latching recess 16 in the housing 3. The latching recess 16 is formed as an outwardly open window.

FIGS. 4 to 8 show that the insertion channel 7 is reduced in cross-section in stages in the depth direction. In the region in which the locking bolt 24 is disposed the convexities 15, 15' are omitted. The lining 5 of the adapter piece 4 can extend into the region of the locking bolt 24. However, in the exemplary embodiment the lining 5 does not reach into this region.

Figure 6:
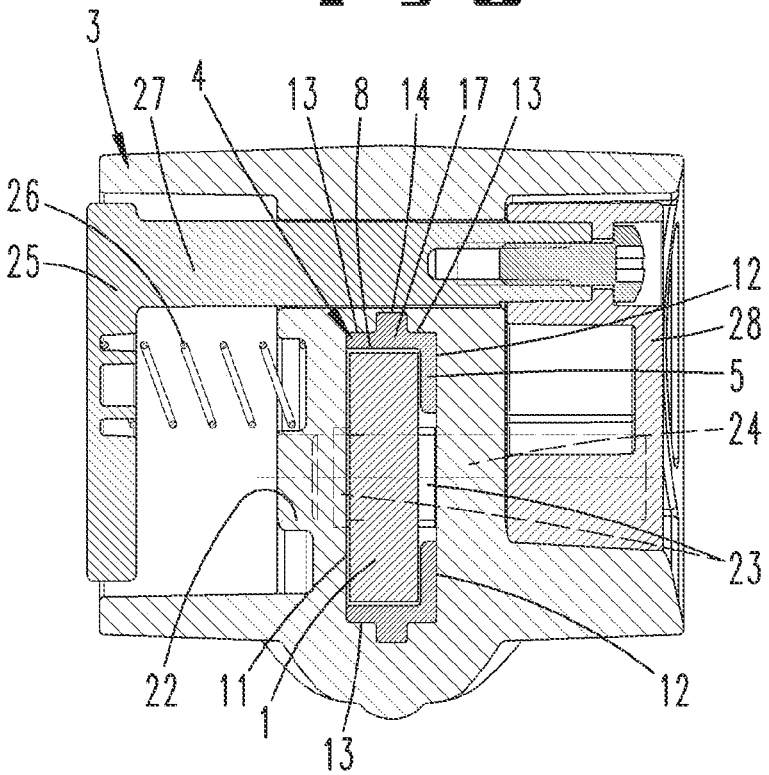
FIG. 6 shows a cross-section according to the sectional line IV-IV in FIG. 1, with an adapter piece 4 inserted into the insertion channel 7 of the rail connector and a rail 1 with a small cross-sectional area inserted into the insertion channel 9 of the adapter piece 4.
Figure 9:
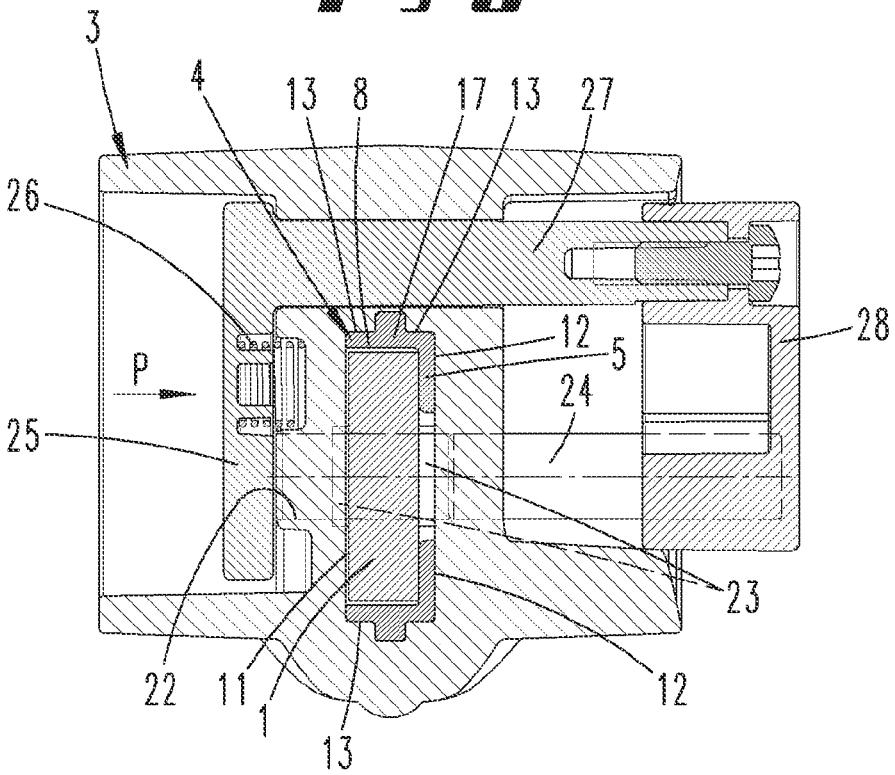
FIG. 9 shows a representation according to FIG. 6, but with the locking bolt 24 brought into the release position.

Both the rail 1 with a small cross-sectional area and also the rail 2 with a larger cross-sectional area are secured to the rail connector 3 by the locking bolt 24 (see FIGS. 6 and 7). If the rod 27 is displaced by pressure on the push button 25 into the position shown in FIG. 9, the locking bolt 24 emerges completely from the insertion channel 7, so that either a rail 1, 2 can be inserted into the rail connector 3 or a rail 1, 2 already inserted into the rail connector 3 inserted can be pulled out of the rail connector 3.

The rib of the narrow wall 17 engaging in the trough-shaped niche 14 gives the cross-section of the narrow wall 17 a T shape, which contributes to stabilization. The edges of the insertion openings 6, 8 are chamfered, so that location surfaces are formed which form the transition between the end face of the flange 10 and the insertion channel 9 or between the end face of the housing 3 and the insertion channel 7. The push buttons 25 have a circular cross-section and are directed to the same broad side of the housing 3. The surfaces of the push buttons 25 must be pressed into the cup-shaped recesses in the housing in order to bring the locking bolt 24 into the release position. The supports 28 emerge on the opposite side from housing recesses in which they rest in the locking position.

The above statements serve for explanation of the inventions covered as a whole by the application, which in each case represent independent modifications of the prior art at least through the following combinations of features, namely:

A device which is characterized by at least one adapter piece 4 which can be inserted into one of the insertion openings 6 and which reduces the free opening cross-section of the insertion channel 7 for insertion of a rail 1 with another cross-sectional surface.

A device which is characterized in that the adapter piece 4 has a lining 5 which adjoins a flange 10, wherein the lining rests at least in some regions against the wall of the insertion channel 7 and in the inserted state forms an insertion channel 9 of reduced cross-section, wherein the flange 10 rests on an end face of the housing 3.

A device which is characterized in that the lining 5 is of U-shaped configuration in cross-section, with narrow walls 17 which extend from a broad side wall 18.

A device which is characterized in that the lining 18 forms a broad side wall 19 which has a bulge 19.

A device which is characterized by a latching device, in particular in the form of a latching lug 20, by which the adapter piece 4 is held in the insertion channel 7, wherein the latching lug 20 projects in particular from a latching spring associated with a broad side wall 18.

A device which is characterized in that the insertion channel 7 in the housing 3 has two opposing convexities 15, 15', in particular for entry of a stop 23 disposed on the rail 2.

A device which is characterized in that the adapter piece 4 forms at least one convexity 21 for entry of a stop 23 disposed on the rail 1.

A device which is characterized in that the insertion opening 6 in the housing 3 and/or the insertion opening 8 of the adapter piece 4 forms a substantially cross-shaped window which is adjoined by the insertion channel (7, 9).

A device which is characterized by a mirror symmetry of the device.

A device which is characterized in that the device has two locking elements, in particular locking bolts 24, for entry respectively into a locking opening 22 in a rail 1, 2 inserted in the housing 3.

A device which is characterized by a push button 25 which can be displaced against a restoring spring 26 in a housing recess, and which is connected by means of a rod 27 to a support 28 earing a locking bolt 24 which in a locking position intersects the insertion channel 7 and can be brought out of the insertion channel 7 by pressure on the push button 25.

All features disclosed are (per se, but also in combination with one another) essential to the invention. The entire content of the disclosure of the associated/appended priority documents (copy of the prior application) is hereby incorporated into the disclosure of the application, for the purpose of also including features of these documents in claims of the present application. The subordinate claims characterize, with their features, independent inventive modifications of the prior art, in particular in order to file divisional applications on the basis of these claims.

LIST OF REFERENCE SIGNS

1 rail
2 rail
3 rail connector
4 adapter piece
5 lining
6 insertion opening
7 insertion channel
8 insertion opening
9 insertion channel
10 flange
11 broad side surface
12 broad side surface
13 Narrow side surface
14 niche
15 convexity
15 convexity
16 latching recess
17 narrow wall
18 broad wall
19 bulge
20 latching lug
21 convexity
22 locking opening
23 stop
24 locking bolt
25 push button
26 spring
27 rod
28 support
29 fixed clamping jaw
30 movable clamping jaw

The invention claimed is:

1. A device for connecting two clamps each having a rail, the device comprising: a housing that has two insertion openings directed away from one another, each inserting opening having an adjoining insertion channel for insertion in each case of a rail; locking means for fastening the rails to the device, the locking means being bringable from a locking position into a release position; at least one adapter piece insertable into one of the insertion openings to reduce a free opening cross-section of the insertion channel for insertion of a rail with another cross-sectional surface; and a latching device by which the adapter piece is held in the insertion channel, wherein the latching device is a latching lug, wherein the latching lug projects from a latching spring associated with a broad side wall of the adapter piece.

2. The device according to claim 1, wherein the adapter piece has a lining which adjoins a flange, wherein the lining rests at least in some regions against a wall of the insertion channel and in an inserted state forms an insertion channel of reduced cross-section, wherein the flange rests on an end face of the housing.

3. The device according to claim 2, wherein the lining has a U-shaped configuration in cross section, with narrow walls that extend from a broad side wall.

4. The device according to claim 3, wherein the broad side wall has a bulge.

5. The device according to claim 1, wherein each of the insertion channels in the housing has two opposing concavities for entry of a stop disposed on the rail.

6. The device according to claim 1, wherein the adapter piece forms at least one concavity for entry of a stop disposed on the rail.

7. The device according to claim 1, wherein each insertion opening in the housing and/or an insertion opening of the adapter piece forms a substantially cross-shaped window which is adjoined by the adjoining insertion channel.

8. The device according to claim 1, wherein the device is mirror symmetric.

9. The device according to claim 1, wherein the locking means have locking elements for entry respectively into a locking opening in a rail inserted in the housing.

10. The device according to claim 9, wherein the locking elements are locking bolts.

11. The device according to claim 1, further comprising a push button displacable against a restoring spring in a recess in the housing, the push button being connected by a rod to a support having a locking bolt that in a locking position intersects the insertion channel and is movable out of the insertion channel by pressure on the push button.

12. A device for connecting two clamps each having a rail, the device comprising: a housing that has two insertion openings directed away from one another, each inserting opening having an adjoining insertion channel for insertion in each case of a rail; locking means for fastening the rails to the device, the locking means being bringable from a locking position into a release position; at least one adapter piece insertable into one of the insertion openings to reduce a free opening cross-section of the insertion channel for insertion of a rail with another cross-sectional surface; and a push button displacable against a restoring spring in a recess in the housing, the push button being connected by a rod to a support having a locking bolt that in a locking position intersects the insertion channel and is movable out of the insertion channel by pressure on the push button.

13. The device according to claim 12, wherein the adapter piece has a lining which adjoins a flange, wherein the lining rests at least in some regions against a wall of the insertion channel and in an inserted state forms an insertion channel of reduced cross-section, wherein the flange rests on an end face of the housing.

14. The device according to claim 13, wherein the lining has a U-shaped configuration in cross-section, with narrow walls that extend from a broad side wall.

15. The device according to claim 14, wherein the broad side wall has a bulge.

16. The device according to claim 12, wherein each of the insertion channels in the housing has two opposing concavities for entry of a stop disposed on the rail.

17. The device according to claim 12, wherein the adapter piece forms at least one concavity for entry of a stop disposed on the rail.

18. The device according to claim 12, wherein each insertion opening in the housing and/or an insertion opening the adapter piece forms a substantially cross-shaped window which is adjoined by the adjoining insertion channel.

19. The device according to claim 12, wherein the device is mirror symmetric.

20. The device according to claim 12, wherein the locking means have locking elements for entry respectively into a locking opening in a rail inserted in the housing.

21. The device according to claim 20, wherein the locking elements are locking bolts.

* * * * *